US012359673B2

(12) United States Patent
Honma et al.

(10) Patent No.: US 12,359,673 B2
(45) Date of Patent: Jul. 15, 2025

(54) VACUUM PUMP AND CONTROL DEVICE

(71) Applicant: Edwards Japan Limited, Yachiyo (JP)

(72) Inventors: Ryutaro Honma, Yachiyo (JP); Kazuya Kasahara, Yachiyo (JP); Hideo Fukami, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 0 days.

(21) Appl. No.: 18/702,673

(22) PCT Filed: Nov. 24, 2022

(86) PCT No.: PCT/JP2022/043432

§ 371 (c)(1),
(2) Date: Apr. 18, 2024

(87) PCT Pub. No.: WO2023/095851

PCT Pub. Date: Jun. 1, 2023

(65) Prior Publication Data

US 2024/0410381 A1 Dec. 12, 2024

(30) Foreign Application Priority Data

Nov. 26, 2021 (JP) ..... 2021-192231

(51) Int. Cl.
*F04D 27/00* (2006.01)
*F04D 19/04* (2006.01)

(52) U.S. Cl.
CPC ..... *F04D 27/008* (2013.01); *F04D 19/04* (2013.01)

(58) Field of Classification Search
CPC ..... F04D 19/04; F04D 27/008
See application file for complete search history.

(56) References Cited

U.S. PATENT DOCUMENTS 6,961,363 B1 11/2005 Anvekar et al.
2003/0175112 A1* 9/2003 Namiki ..... F04D 25/16 415/90

(Continued)

FOREIGN PATENT DOCUMENTS

JP 2012004759 A 1/2012
JP 2017153050 A 8/2017

(Continued)

OTHER PUBLICATIONS

International Search Report and Written Opinion of International Application No. PCT/JP2022/043432, dated Feb. 21, 2023, 8 Pages.

(Continued)

*Primary Examiner* — Audrey B. Walter
(74) *Attorney, Agent, or Firm* — Shumaker & Sieffert, P.A.

(57) ABSTRACT

A vacuum pump that allows for the identification of the noise immunities or the like of a master circuit and one or more slave circuits for controlling an operation of at least one portion included in the vacuum pump, and a controller used for such a vacuum pump are proposed. The present disclosure includes a control means 200 configured to control an operation of at least one portion included in a vacuum pump 100. The control means 200 includes a slave circuit 201, 202 connected to the at least one portion to control the operation of the at least one portion and a master circuit 204 connected to the slave circuit 201, 202 to control the slave circuit 201, 202. The master circuit 204 is configured to perform periodical communications with the slave circuit 201, 202 and obtain a history of communication states in the communications.

10 Claims, 6 Drawing Sheets

(56) References Cited

U.S. PATENT DOCUMENTS

| | | | | |
|---|---|---|---|---|
| 2009/0287789 | A1* | 11/2009 | Dolan | G06F 13/385 709/208 |
| 2017/0250883 | A1 | 8/2017 | Sawada et al. | |
| 2022/0333607 | A1 | 10/2022 | Fukami et al. | |

FOREIGN PATENT DOCUMENTS

| | | | | |
|---|---|---|---|---|
| JP | 2019022106 | A | 2/2019 | |
| JP | 2021055586 | A | 4/2021 | |
| WO | WO-2010034261 | A1 * | 4/2010 | B60T 13/52 |

OTHER PUBLICATIONS

Office Action, and translation thereof, from counterpart JP Application No. 2021-192231, dated Jul. 18, 2023, 7 Pages.
Office Action, and translation thereof, from counterpart JP Application No. 2021-192231, dated Nov. 30, 2023, 7 Pages.
Notification of Reason for Refusal, and translation thereof, from counterpart Japanese Application No. 2021-192231 dated May 7, 2024, 6 pp.

* cited by examiner

VACUUM PUMP AND CONTROL DEVICE

This application is a national stage entry under 35 U.S.C. § 371 of International Application No. PCT/JP2022/043432, filed Nov. 24, 2022, which claims the benefit of JP Application No. 2021-192231, filed Nov. 26, 2021, the entire contents of each of which are incorporated herein by reference.

TECHNICAL FIELD

The present disclosure relates to a vacuum pump and a controller used for the vacuum pump.

BACKGROUND

Vacuum pumps are used in apparatuses such as semiconductor manufacturing apparatuses, electron microscopes, and mass spectrometers to produce high vacuums in vacuum chambers. Among various vacuum pumps, turbomolecular pumps, in particular, are widely used for reasons such as less residual gas and easy maintenance.

As shown in PTL 1, a turbomolecular pump includes a rotor shaft having an outer circumference surface on which rotor blades are arranged in multiple stages. This rotor shaft is rotatably supported in a casing. Stator blades are arranged in multiple stages on the inner circumference surface of the casing and positioned between the rotor blades. The rotor is rotated at high speed by a motor after the pressure in the vacuum chamber is reduced to some extent, thereby causing the rotor blades and the stator blades to collide with gas molecules. The gas molecules are thus given momentum and exhausted. This exhaust operation compresses and exhausts the gas molecules drawn from the vacuum chamber into the pump, thereby creating a predetermined high degree of vacuum in the vacuum chamber.

The rotor shaft is rotatably supported by, for example, a magnetic bearing of 5-axis control, which suspends the rotor shaft in the air and also controls the position thereof. The motor includes a plurality of magnetic poles circumferentially arranged to surround the rotor shaft. The magnetic poles drive and rotate the rotor shaft by electromagnetic forces acting between the magnetic poles and the rotor shaft.

The magnetic bearing includes electromagnets that exert electromagnetic forces on the rotor shaft. A magnetic bearing control circuit (the magnetic bearing control portion in PTL 1) controls these electromagnets to support the rotor shaft in a non-contact manner. The motor is controlled by a motor control circuit (the motor drive control portion in PTL 1) to drive and rotate the rotor shaft by the electromagnetic forces from the magnetic poles and acting between the rotor shaft and the magnetic poles.

The magnetic bearing control circuit and the motor control circuit are connected to a control circuit (the protection function processing portion in PTL 1). The control circuit controls the magnetic bearing control circuit and the motor control circuit so that the operating state of the electromagnets, which is controlled by the magnetic bearing control circuit, and the operating state of the motor, which is controlled by the motor control circuit, are in preset ranges. That is, the control circuit corresponds to a "master circuit" in a master-slave system, and the magnetic bearing control circuit and the motor control circuit correspond to "slave circuits" in the master-slave control. The control circuit also has the function of monitoring the operating state of the electromagnets and the operating state of the motor to issue an alarm or to stop the turbomolecular pump when these operating states deviate from the preset ranges.

SUMMARY OF THE INVENTION

In the communications between the master circuit and the slave circuits, errors may arise due to factors such as external noise. Even in such a case, the software may be designed to appropriately maintain the integrity of the data used in communications, so that the operation of the turbomolecular pump may not directly affected in principle. However, since circuits may vary in terms of noise immunity due to the variations among devices or the like, the operation of a turbomolecular pump may be affected when a circuit with low immunity is used. Also, even when circuits are normal, unexpected external noise may occur depending on the environment in which the turbomolecular pump is used. This may cause a communication error.

In view of the foregoing, it is an object of the present disclosure to provide a vacuum pump and a controller that are capable of evaluating the quality of communications between a master circuit and one or more slave circuits that control operations of portions of the vacuum pump, thereby identifying the noise immunities or the like of the circuits, and thus improving the stability of the operations.

The present disclosure includes a control means to control an operation of at least one portion included in a vacuum pump. The control means includes a one or more slave circuits connected to the at least one portion to control the operation of the at least one portion and a master circuit connected to the one or more slave circuits to control the one or more slave circuits. The master circuit may be configured to perform periodical communications with the one or more slave circuits and obtain a history of communication states of the communications.

This vacuum pump preferably issues an alarm to an outside, based on the history of communication states.

The alarm may preferably be issued based on a total number of communication errors in a predetermined period.

The alarm may be issued based on an occurrence ratio of communication errors in a predetermined period.

The alarm may be issued in response to a plurality of communication errors occurring in succession.

The history of communication states includes at least one of request content of data, response content of data, an error type, or a time of a most recent communication error.

The present disclosure relates to a controller for controlling an operation of at least one portion included in a vacuum pump. The controller includes a one or more slave circuits connected to the at least one portion to control the operation of the at least one portion and a master circuit connected to the one or more slave circuits to control the one or more slave circuits. The master circuit may be configured to perform periodical communications with the one or more slave circuits and obtain a history of communication states of the communications.

According to the vacuum pump and the controller of the present disclosure, the master circuit performs periodical communications with the one or more slave circuits and obtains a history of communication states of the communications. As such, the obtained history of communication states can be used to evaluate the communication quality, thereby allowing for the identification of the noise immunities or the like of the master circuit and the one or more slave circuits based on the evaluation. The identified noise immunities or the like may be used to appropriately take various measures to further improve the stability of the operation of the vacuum pump.

DETAILED DESCRIPTION

Figure 1:
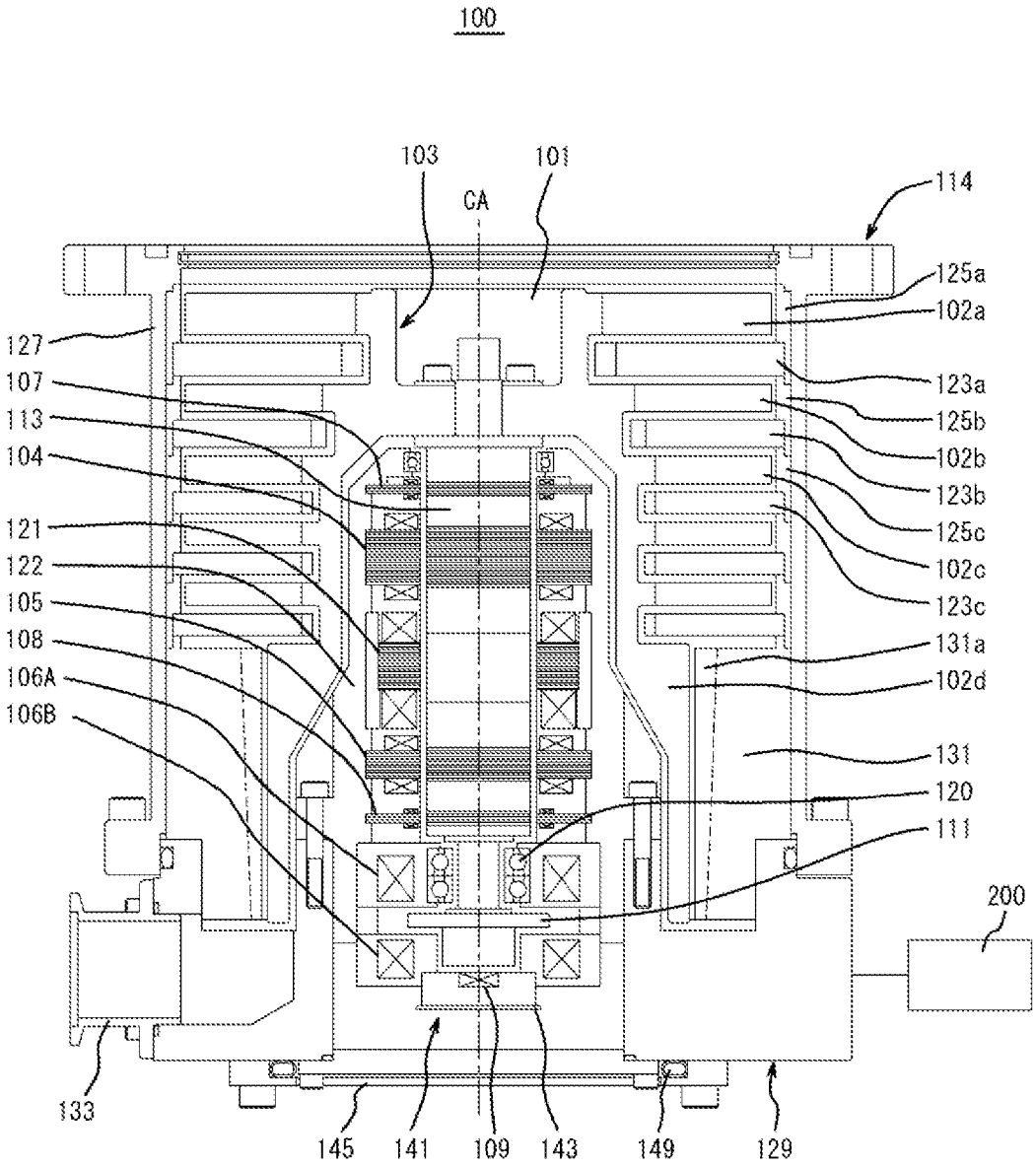
FIG. 1 is a vertical cross-sectional view schematically showing an example of a vacuum pump according to the present disclosure.

Referring to the drawings, a turbomolecular pump 100 of an example of a vacuum pump according to the present disclosure is now described. First, referring to FIGS. 1 to 4, the overall configuration of the turbomolecular pump 100 is described.

FIG. 1 is a vertical cross-sectional view of the turbomolecular pump 100. As shown in FIG. 1, the turbomolecular pump 100 has a circular outer cylinder 127 having an inlet port 101 at its upper end. A rotating body 103 in the outer cylinder 127 includes a plurality of rotor blades 102 (102*a*, 102*b*, 102*c*, . . . ), which are turbine blades for gas suction and exhaustion, in its outer circumference section. The rotor blades 102 extend radially in multiple stages. The rotating body 103 has a rotor shaft 113 in its center. The rotor shaft 113 may be supported and suspended in the air and position-controlled by a magnetic bearing 115 (FIG. 5) of 5-axis control, for example. The magnetic bearing 115 includes electromagnets 104, 105, 106A, and 106B, which will be described below and shown in FIG. 1. The rotating body 103 may typically be made of a metal such as aluminum or an aluminum alloy.

Upper radial electromagnets 104 include four electromagnets arranged in pairs on an X-axis and a Y-axis. Four upper radial sensors 107 are provided in close proximity to the upper radial electromagnets 104 and associated with the respective upper radial electromagnets 104. Upper radial sensor 107 may be an inductance sensor or an eddy current sensor having a conduction winding, for example, and detects the position of the rotor shaft 113 based on a change in the inductance of the conduction winding, which changes according to the position of the rotor shaft 113. The upper radial sensors 107 are configured to detect a radial displacement of the rotor shaft 113, that is, the rotating body 103 fixed to the rotor shaft 113, and send it to the controller 200. The controller (control means) 200 of the present example includes a magnetic bearing control circuit 201 and a motor control circuit 202 shown in FIG. 5.

In the magnetic bearing control circuit 201, for example, a compensation circuit having a PID adjustment function generates an excitation control command signal for the upper radial electromagnets 104 based on a position signal detected by the upper radial sensors 107. Based on this excitation control command signal, an amplifier circuit 150 (described below) shown in FIG. 2 controls and excites the upper radial electromagnets 104 to adjust the radial position of the upper part of the rotor shaft 113.

The rotor shaft 113 may be made of a high magnetic permeability material (such as iron and stainless steel) and may be configured to be attracted by magnetic forces of the upper radial electromagnets 104. The adjustment may be performed independently in the X-axis direction and the Y-axis direction. Lower radial electromagnets 105 and lower radial sensors 108 are arranged in a similar manner as the upper radial electromagnets 104 and the upper radial sensors 107 to adjust the radial position of the lower part of the rotor shaft 113 in a similar manner as the radial position of the upper part.

Additionally, axial electromagnets 106A and 106B are arranged so as to vertically sandwich a metal disc 111, which has a shape of a circular disc and may be provided in the lower part of the rotor shaft 113. The metal disc 111 may be made of a high magnetic permeability material such as iron. An axial sensor 109 may be provided to detect an axial displacement of the rotor shaft 113 and send an axial position signal to the magnetic bearing control circuit 201.

In the magnetic bearing control circuit 201, the compensation circuit having the PID adjustment function may generate an excitation control command signal for one or more of the axial electromagnets 106A and 106B based on the signal on the axial position detected by the axial sensor 109. Based on these excitation control command signals, the amplifier circuit 150 controls and excites the axial electromagnets 106A and 106B separately so that the axial electromagnet 106A magnetically attracts the metal disc 111 upward and the axial electromagnet 106B attracts the metal disc 111 downward. The axial position of the rotor shaft 113 may thus adjusted.

As described above, the magnetic bearing control circuit 201 appropriately adjusts the magnetic forces exerted by the axial electromagnets 106A and 106B on the metal disc 111, magnetically levitates the rotor shaft 113 in the axial direction, and suspends the rotor shaft 113 in the air in a non-contact manner. The amplifier circuit 150, which controls and excites the upper radial electromagnets 104, the lower radial electromagnets 105, and the axial electromagnets 106A and 106B, is described below.

The motor 121 includes a plurality of magnetic poles circumferentially arranged to surround the rotor shaft 113. One or more magnetic poles may be controlled by the motor control circuit 202 so as to drive and rotate the rotor shaft 113 via an electromagnetic force acting between the magnetic pole and the rotor shaft 113. The motor 121 also includes a rotational speed sensor (not shown), such as a Hall element, a resolver, or an encoder, and the rotational speed of the rotor shaft 113 may be detected based on a detection signal of the rotational speed sensor.

Furthermore, a phase sensor (not shown) may be attached adjacent to the lower radial sensors 108 to detect the phase of rotation of the rotor shaft 113. The motor control circuit 200 detects the position of the magnetic poles using both detection signals of the phase sensor and the rotational speed sensor.

A plurality of stator blades 123 (123*a*, 123*b*, 123*c*, . . . ) are arranged slightly spaced apart from the rotor blades 102 (102*a*, 102*b*, 102*c*, . . . ). Rotor blade 102 (102*a*, 102*b*, 102*c*, . . . ) may be inclined by a predetermined angle from a plane perpendicular to the axis of the rotor shaft 113 in order to transfer exhaust gas molecules downward through collision. The stator blades 123 (123*a*, 123*b*, 123*c*, . . . ) are made of a metal such as aluminum, iron, stainless steel, copper, or a metal such as an alloy containing these metals as components.

The stator blades 123 are also inclined by a predetermined angle from a plane perpendicular to the axis of the rotor shaft 113. The stator blades 123 extend inward of the outer cylinder 127 and alternate with the stages of the rotor blades 102. The outer circumference ends of the stator blades 123 are inserted between and thus supported by a plurality of layered stator blade spacers 125 (125*a*, 125*b*, 125*c*, . . . ).

The stator blade spacers 125 are ring-shaped members made of a metal, such as aluminum, iron, stainless steel, or copper, or an alloy containing these metals as components, for example. The outer cylinder 127 may be fixed to the outer circumferences of the stator blade spacers 125 with a slight gap. A base portion 129 may be located at the base of the outer cylinder 127. The base portion 129 has an outlet port 133 providing communication to the outside. The exhaust gas transferred to the base portion 129 through the inlet port 101 from the chamber (vacuum chamber) side may then sent to the outlet port 133.

According to the application of the turbomolecular pump 100, a threaded spacer 131 may be provided between the lower part of the stator blade spacer 125 and the base portion 129. The threaded spacer 131 may include a cylindrical member made of a metal such as aluminum, copper, stainless steel, or iron, or an alloy containing these metals as components. The threaded spacer 131 has a plurality of helical thread grooves 131*a* in its inner circumference surface. When exhaust gas molecules move in the rotation direction of the rotating body 103, these molecules are transferred toward the outlet port 133 in the direction of the helix of the thread grooves 131*a*. In the lowermost section of the rotating body 103 below the rotor blades 102 (102*a*, 102*b*, 102*c*, . . . ), a cylindrical portion 102*d* extends downward. The outer circumference surface of the cylindrical portion 102*d* may be cylindrical and projects toward the inner circumference surface of the threaded spacer 131. The outer circumference surface may be adjacent to but separated from the inner circumference surface of the threaded spacer 131 by a predetermined gap. The exhaust gas transferred to the thread grooves 131*a* by the rotor blades 102 and the stator blades 123 may be guided by the thread grooves 131*a* to the base portion 129.

The base portion 129 may include a disc-shaped member forming the base section of the turbomolecular pump 100, and may generally be made of a metal such as iron, aluminum, or stainless steel. The base portion 129 physically holds the turbomolecular pump 100 and also serves as a heat conduction path. As such, the base portion 129 may preferably be made of rigid metal with high thermal conductivity, such as iron, aluminum, or copper.

In this configuration, when the motor 121 drives and rotates the rotor blades 102 together with the rotor shaft 113, the interaction between the rotor blades 102 and the stator blades 123 causes the suction of exhaust gas from the chamber through the inlet port 101. The rotational speed of the rotor blades 102 is usually 20000 rpm to 90000 rpm, and the circumferential speed at the tip of a rotor blade 102 reaches 200 m/s to 400 m/s. The exhaust gas taken through the inlet port 101 moves between the rotor blades 102 and the stator blades 123 and may be transferred to the base portion 129. At this time, factors such as the friction heat generated when the exhaust gas comes into contact with the rotor blades 102 and the conduction of heat generated by the motor 121 increase the temperature of the rotor blades 102. This heat may be conducted to the stator blades 123 through radiation or conduction via gas molecules of the exhaust gas, for example.

The stator blade spacers 125 are joined at the outer circumference portion and conduct the heat received by the stator blades 123 from the rotor blades 102, the friction heat generated when the exhaust gas comes into contact with the stator blades 123, and the like to a main body casing portion 114.

In the above description, the threaded spacer 131 may be provided at the outer circumference of the cylindrical portion 102*d* of the rotating body 103, and the thread grooves 131*a* are engraved in the inner circumference surface of the threaded spacer 131. However, this may be inversed in some cases, and a thread groove may be engraved in the outer circumference surface of the cylindrical portion 102*d*, while a spacer having a cylindrical inner circumference surface may be arranged around the outer circumference surface.

According to the application of the turbomolecular pump 100, to prevent the gas drawn through the inlet port 101 from entering an electrical portion, which includes the upper radial electromagnets 104, the upper radial sensors 107, the motor 121, the lower radial electromagnets 105, the lower radial sensors 108, the axial electromagnets 106A, 106B, and the axial sensor 109, the electrical portion may be surrounded by a stator column 122. The inside of the stator column 122 may be maintained at a predetermined pressure by purge gas.

In this case, the base portion 129 has a pipe (not shown) through which the purge gas may be introduced. The introduced purge gas may be sent to the outlet port 133 through gaps between a protective bearing 120 and the rotor shaft 113, between the rotor and the stator of the motor 121, and between the stator column 122 and the inner circumference cylindrical portion of the rotor blade 102.

The turbomolecular pump 100 may obtain the identification of the model and control based on individually adjusted unique parameters (for example, various characteristics associated with the model). To store these control parameters, the turbomolecular pump 100 includes an electronic circuit portion 141 in its main body. The electronic circuit portion 141 may include a semiconductor memory, such as an EEPROM, electronic components such as semiconductor elements for accessing the semiconductor memory, and a substrate 143 for mounting these components. The electronic circuit portion 141 may be housed under a rotational speed sensor (not shown) near the center, for example, of the base portion 129, which forms the lower part of the turbomolecular pump 100, and may be closed by an airtight bottom lid 145.

Some process gas introduced into the chamber in the manufacturing process of semiconductors has the property of becoming solid when its pressure becomes higher than a predetermined value or its temperature becomes lower than a predetermined value. In the turbomolecular pump 100, the pressure of the exhaust gas may be lowest at the inlet port 101 and highest at the outlet port 133. When the pressure of the process gas increases beyond a predetermined value or its temperature decreases below a predetermined value while the process gas is being transferred from the inlet port 101 to the outlet port 133, the process gas may be solidified and adheres and accumulates on the inner side of the turbomolecular pump 100.

For example, when $SiCl_4$ is used as the process gas in an Al etching apparatus, according to the vapor pressure curve, a solid product (for example, $AlCl_3$) may be deposited at a low vacuum (760 [torr] to 10−2 [torr]) and a low temperature (about 20 [° C.]) and adheres and accumulates on the inner side of the turbomolecular pump 100. When the deposit of the process gas accumulates in the turbomolecular pump 100, the accumulation may narrow the pump flow passage and degrade the performance of the turbomolecular pump 100. The above-mentioned product tends to solidify and adhere in areas with higher pressures, such as the vicinity of the outlet port and the vicinity of the threaded spacer 131.

To solve this problem, conventionally, an annular water-cooled tube 149 may be wound around the outer circumference of the main body casing portion or the base portion 129, and a temperature sensor (e.g., a thermistor, not shown) may be embedded in the base portion 129, for example. The signal of this temperature sensor may be used to perform control to maintain the temperature of the base portion 129 at a constant high temperature (preset temperature) by heating with the heater or cooling with the water-cooled tube 149 (hereinafter referred to as TMS (temperature management system)).

Figure 2:
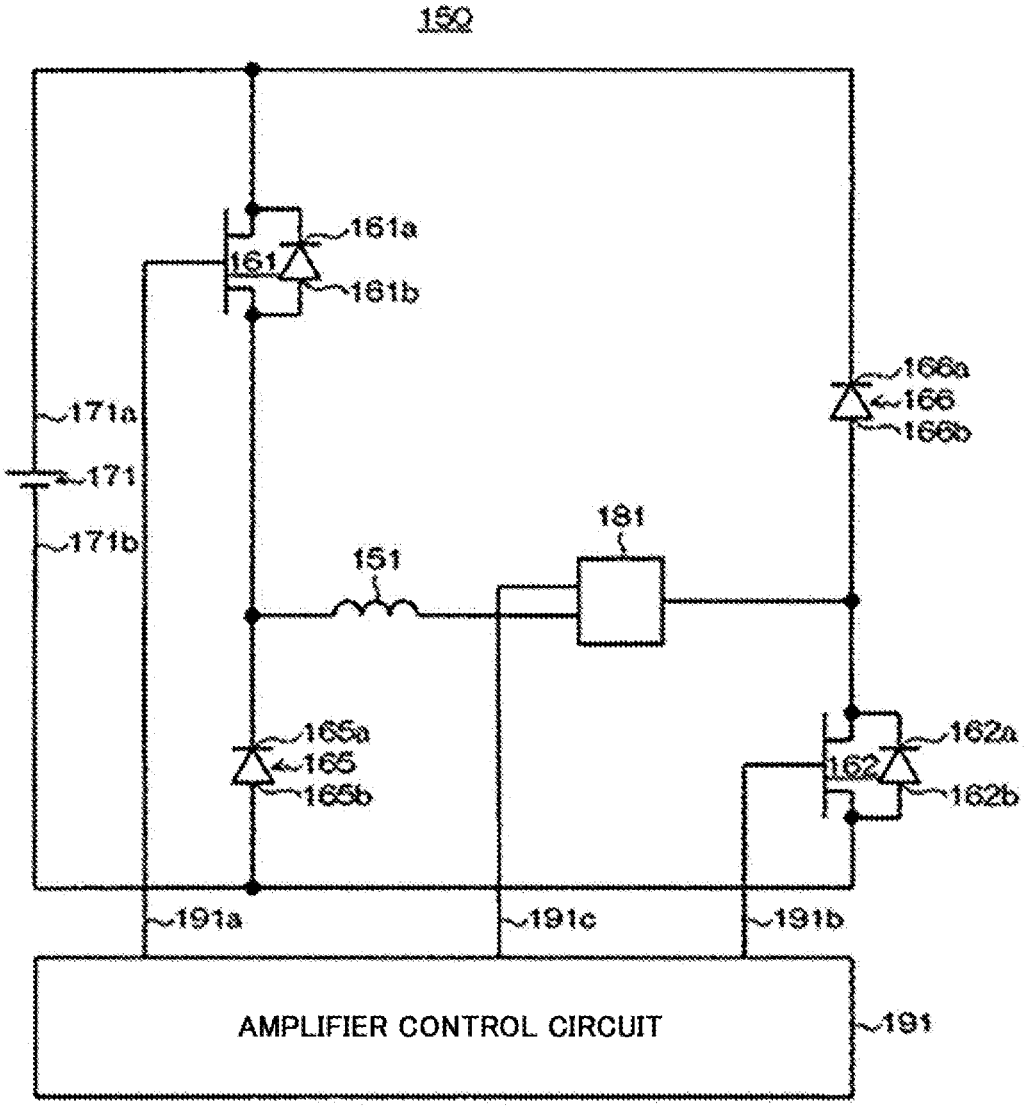
FIG. 2 is a circuit diagram of an amplifier circuit of the vacuum pump shown in FIG. 1.

The amplifier circuit 150 is now described that controls and excites the upper radial electromagnets 104, the lower radial electromagnets 105, and the axial electromagnets 106A and 106B of the turbomolecular pump 100 configured as described above. FIG. 2 is a circuit diagram of the amplifier circuit 150.

In FIG. 2, one end of an electromagnet winding 151 forming an upper radial electromagnet 104 or the like may be connected to a positive electrode 171*a* of a power supply 171 via a transistor 161, and the other end may be connected to a negative electrode 171*b* of the power supply 171 via a current detection circuit 181 and a transistor 162. Transistor 161, 162 may include a power MOSFET and has a structure in which a diode may be connected between the source and the drain thereof.

In the transistor 161, a cathode terminal 161*a* of its diode may be connected to the positive electrode 171*a*, and an anode terminal 161*b* may be connected to one end of the electromagnet winding 151. In the transistor 162, a cathode terminal 162*a* of its diode may be connected to a current detection circuit 181, and an anode terminal 162*b* may be connected to the negative electrode 171*b*.

A diode 165 for current regeneration has a cathode terminal 165*a* connected to one end of the electromagnet winding 151 and an anode terminal 165*b* connected to the negative electrode 171*b*. Similarly, a diode 166 for current regeneration has a cathode terminal 166*a* connected to the positive electrode 171*a* and an anode terminal 166*b* connected to the other end of the electromagnet winding 151 via the current detection circuit 181. The current detection circuit 181 may include a Hall current sensor or an electric resistance element, for example.

The amplifier circuit 150 configured as described above corresponds to one electromagnet. Accordingly, when the magnetic bearing uses 5-axis control and has ten electromagnets 104, 105, 106A, and 106B in total, an identical amplifier circuit 150 may be configured for one or more of the electromagnets. These ten amplifier circuits 150 are connected to the power supply 171 in parallel.

An amplifier control circuit 191 may be formed by a digital signal processor portion (not shown, hereinafter referred to as a DSP portion) of the controller 200. The amplifier control circuit 191 switches the transistors 161 and 162 between on and off.

The amplifier control circuit 191 may be configured to compare a current value detected by the current detection circuit 181 (a signal reflecting this current value is referred to as a current detection signal 191*c*) with a predetermined current command value. The result of this comparison may be used to determine the magnitude of the pulse width (pulse width time Tp1, Tp2) generated in a control cycle Ts, which may represent one cycle in PWM control. As a result, gate drive signals 191*a* and 191*b* having this pulse width are output from the amplifier control circuit 191 to gate terminals of the transistors 161 and 162.

Under circumstances such as when the rotational speed of the rotating body 103 reaches a resonance point during acceleration, or when a disturbance occurs during a constant speed operation, the rotating body 103 may be configured with positional control at high speed and with a strong force. For this purpose, a high voltage of about 50 V, for example, is used for the power supply 171 to enable a rapid increase (or decrease) in the current flowing through the electromagnet winding 151. Additionally, a capacitor may generally connected between the positive electrode 171*a* and the negative electrode 171*b* of the power supply 171 to stabilize the power supply 171 (not shown).

In this configuration, when both transistors 161 and 162 are turned on, the current flowing through the electromagnet winding 151 (hereinafter referred to as an electromagnet current iL) increases, and when both are turned off, the electromagnet current iL decreases.

Also, when one of the transistors 161 and 162 is turned on and the other is turned off, a freewheeling current may be maintained. Passing the freewheeling current through the amplifier circuit 150 in this manner reduces the hysteresis loss in the amplifier circuit 150, thereby limiting the power consumption of the circuit to a low level. Moreover, by controlling the transistors 161 and 162 as described above, high frequency noise, such as harmonics, generated in the turbomolecular pump 100 can be reduced. Furthermore, by measuring this freewheeling current with the current detection circuit 181, the electromagnet current iL flowing through the electromagnet winding 151 can be detected.

Figure 3:
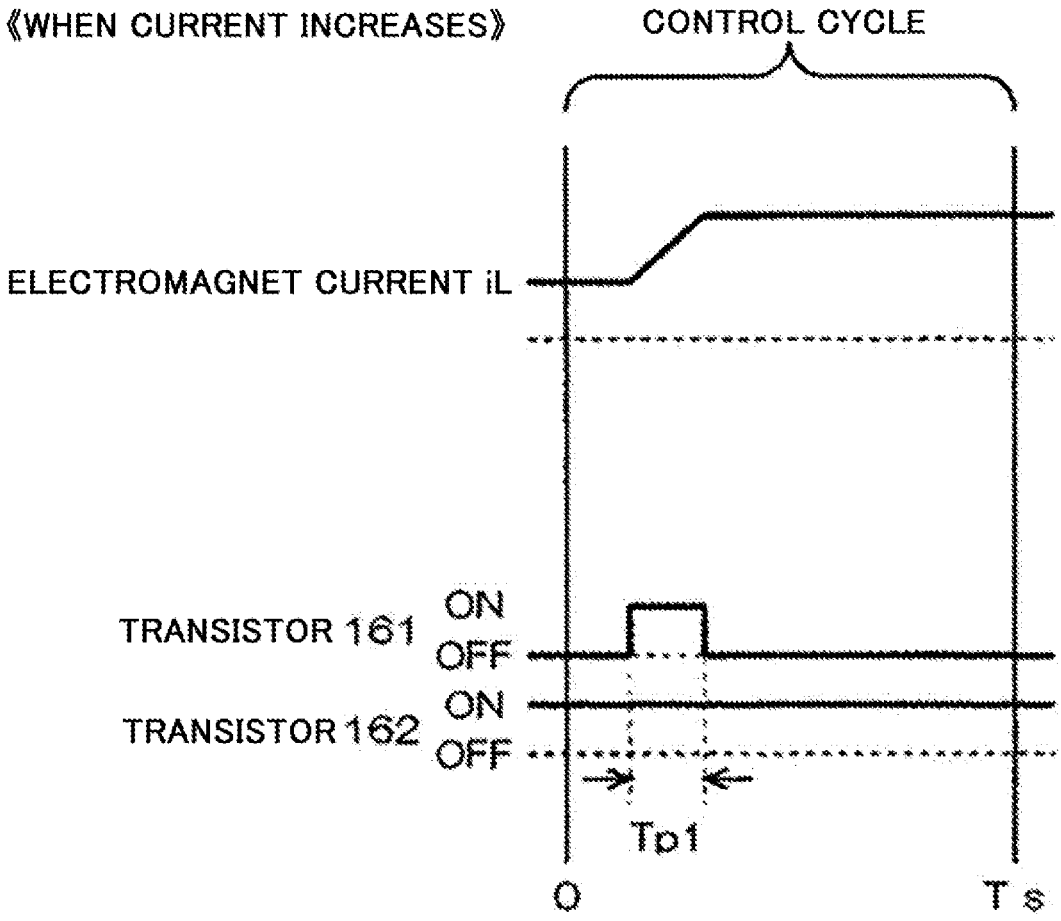
FIG. 3 is a time chart showing control performed when a current command value is greater than a detected value.

That is, when the detected current value is smaller than the current command value, as shown in FIG. 3, the transistors 161 and 162 are simultaneously on once in the control cycle Ts (for example, 100 μs) for the time corresponding to the pulse width time Tp1. During this time, the electromagnet current iL increases accordingly toward the current value iLmax (not shown) that can be passed from the positive electrode 171*a* to the negative electrode 171*b* via the transistors 161 and 162.

Figure 4:
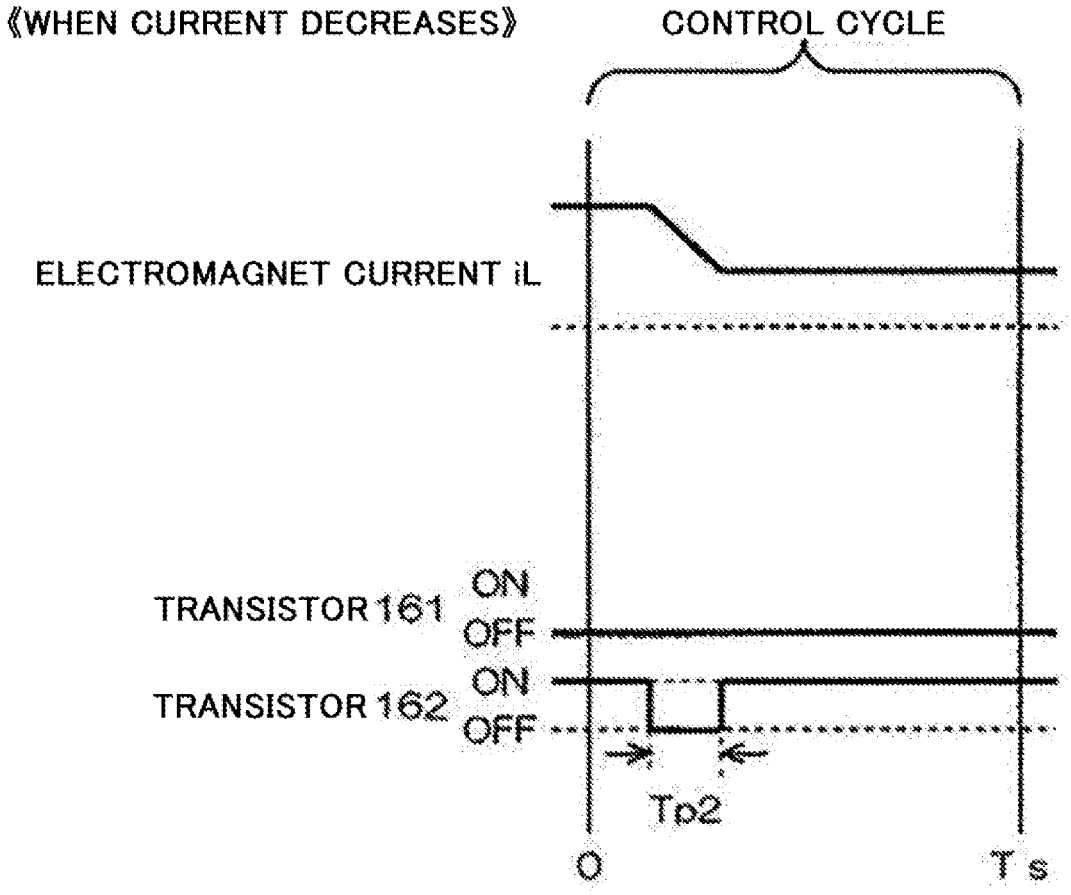
FIG. 4 is a time chart showing control performed when the current command value is less than a detected value.

When the detected current value is larger than the current command value, as shown in FIG. 4, the transistors 161 and 162 are simultaneously off once in the control cycle Ts for the time corresponding to the pulse width time Tp2. During this time, the electromagnet current iL decreases accordingly toward the current value iLmin (not shown) that can be regenerated from the negative electrode 171*b* to the positive electrode 171*a* via the diodes 165 and 166.

In either case, after the pulse width time Tp1, Tp2 has elapsed, one of the transistors 161 and 162 may be on. During this period, the freewheeling current is thus maintained in the amplifier circuit 150.

Figure 5:
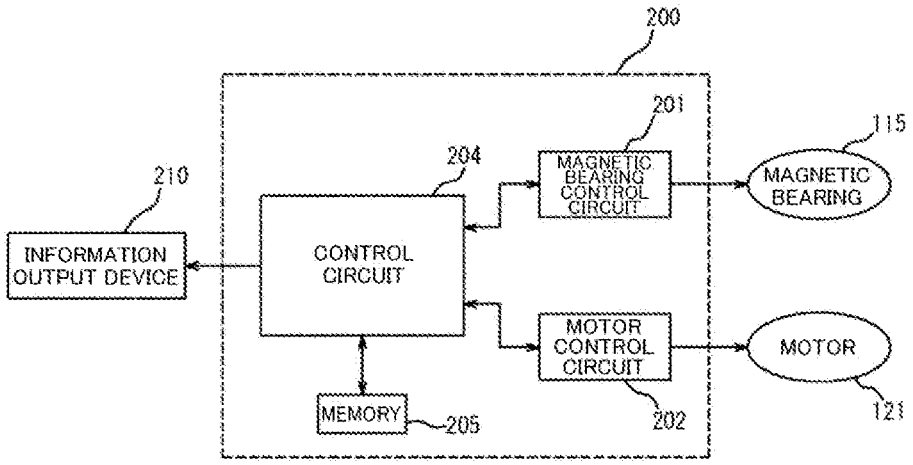
FIG. 5 is a block diagram of the controller shown in FIG. 1.

Referring to FIG. 5, the controller 200 (control means) of the present example is now described in detail. The controller 200 of the present example includes the magnetic bearing control circuit 201, the motor control circuit 202, the control circuit 204, and a memory 205.

The magnetic bearing control circuit 201 may be connected to the sensors 107, 108, and 109 described above in addition to the magnetic bearing 115 (including the above-mentioned electromagnets 104, 105, 106A, and 106B in this example) and controls the operation of the magnetic bearing 115 based on the position information of the rotor shaft 113 detected by the sensors 107, 108, and 109.

The motor control circuit 202 may be connected to the above-mentioned motor 121 (incorporating a rotational speed sensor (not shown)) and a phase sensor (not shown) and controls the operation of the motor 121 based on the rotational speed and the phase of the rotor shaft 113 detected by the rotational speed sensor and the phase sensor.

The control circuit 204 may be connected to the magnetic bearing control circuit 201 and the motor control circuit 202. The control circuit 204 periodically communicates with the magnetic bearing control circuit 201 and with the motor control circuit 202, and thus controls the operation of the magnetic bearing 115, which may be connected to the magnetic bearing control circuit 201, and the operation of the motor 121, which may be connected to the motor control circuit 202. That is, the control circuit 204 corresponds to a "master circuit" in a master-slave system, and the magnetic bearing control circuit 201 and the motor control circuit 202 correspond to "slave circuits" in the master-slave control. In one example, the interval of communications performed by the control circuit 204 with the magnetic bearing control circuit 201 and the motor control circuit 202 may be 30 ms to 100 ms.

The control circuit 204 may be connected to the memory 205. The memory 205 may be a FeRAM, for example. The memory 205 may be a non-volatile memory (for example, EEPROM) other than FeRAM, or a volatile memory (SRAM or DRAM). The control circuit 204 also has the function of storing a "history of communication states" described below in the memory 205 and calling it from the memory 205.

The control circuit 204 may be connected to an information output device 210. For example, the information output device 210 may be an LCD attached to the turbomolecular pump 100, and displays various types of information about the turbomolecular pump 100 in texts, images, and the like so that the user can perceive it. The information output device 210 may be a component that emits light (blinks), such as an LED. Also, the information output device 210 is not limited to a component that allows the user to visually perceive the information, such as an LCD and an LED, and may be a component that allows for perception through another sense (for example, sound may be output and perceived by the user's sense of hearing).

The control circuit 204 of the present example has the function of obtaining the history of states of communications with the magnetic bearing control circuit 201 and the motor control circuit 202, which are slave circuits.

Figure 6:
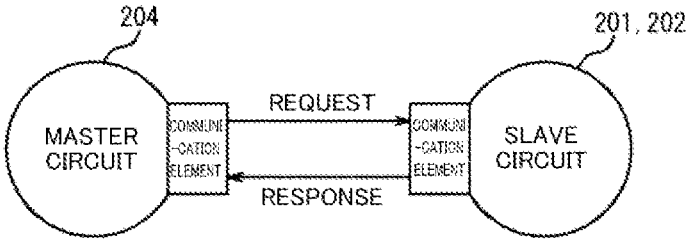
FIG. 6 is a diagram illustrating a master circuit and a slave circuit in a controller.

Referring to FIG. 6, the "history of communication states" is now described in detail. When the control circuit 204, which is the master circuit, transmits data including request content to the magnetic bearing control circuit 201 (or the motor control circuit 202), which is a slave circuit, the magnetic bearing control circuit 201 (or the motor control circuit 202) transmits data including response content to the control circuit 204. The control circuit 204 of the present example has the function of counting the number of communications performed between the master circuit and the slave circuits, and can calculate the total number of communications between the master circuit and the slave circuits. In an example of a method for counting the number of communications, the cumulative number may be stored in the memory 205, and the control circuit 204 counts up this cumulative number in the memory 205 when the master circuit communicates with one or more slave circuits. This total number of communications may be included in the "history of communication states".

The "history of communication states" also includes the history of communication errors that occur between the master circuit and the slave circuits. The types of "communication error" include an error that occurs when the communication element of the master circuit is abnormal and data cannot be sent to the slave circuit, an error that occurs when the master circuit sends data and then fails to receive data from the slave circuit, an error that occurs when data from the slave circuit cannot be used, and an error that occurs when data from the slave circuit is usable but not expected data (for example, the numerical value in the data is not in the specified range). Regarding the communication errors described above, the control circuit 204 of the present example has the function of counting the number of communication errors of each type in a predetermined period and counting the total number of communication errors in a predetermined period. The control circuit 204 also has the function of calculating the occurrence ratio of communication errors in a predetermined period (for example, the ratio obtained by dividing the number of communication errors of each type by the total number of communications between the master circuit and the slave circuits, and the ratio obtained by dividing the total number of communication errors by the total number of communications between the master circuit and the slave circuits). The "predetermined period" is not limited to the period from the time of the initial startup of the turbomolecular pump 100 to the current time, and may be a specific period. That is, in counting the number of communication errors and the like, the number of communication errors from the initial startup of the turbomolecular pump 100 may be counted, or the number of communication errors after a periodical inspection of the turbomolecular pump 100 may be counted.

The control circuit 204 also has the function of detecting a plurality of communication errors occurring in succession.

The "history of communication states" includes, regarding the most recent communication error, at least one of data including the request content sent by the master circuit to the slave circuit, data including the response content sent by the slave circuit to the master circuit, the type of the communication error, or the time at which the communication error occurred. As described above, the memory 205 stores the "history of communication states". Storing the error occurrence times or the like for communication errors would result in an enormous volume of data stored in the memory 205. For this reason, the present example stores the error occurrence time or the like for the most recent communication error (the previously stored data is deleted from the memory 205). This minimizes the volume of data to be stored in the memory 205.

As for the "history of communication states" described above, the control circuit 204 also has the function of issuing an alarm to the outside based on the "history of communication states". In the present example, the control circuit 204 may be configured to cause the information output device 210 to issue an alarm (for example, causes an LCD to display that the turbomolecular pump 100 has an abnormality) when the total number of communication errors in a predetermined period exceeds a predetermined number. The information representing the above "predetermined number" may be stored in the memory 205 or a storage portion (not shown) as a threshold value. The control circuit 204 sends a signal to the information output device 210 when the total number of communication errors exceeds the threshold value stored in the memory 205 or the like to cause the information output device 210 to issue an alarm. This allows the user to perceive that the turbomolecular pump 100 has an abnormality.

The signal sent from the control circuit 204 to cause the information output device 210 to issue an alarm does not have to be based on the total number of communication errors in a predetermined period. An alarm may be issued based on the occurrence ratio of communication errors in a predetermined period, or in response to a plurality of communication errors occurring in succession.

As described above, the memory 205 stores the "history of communication states". That is, even when sudden external noise causes a communication error, for example, the cause of the communication error can be identified by analyzing the data on the "history of communication states" stored in the memory 205, allowing effective measures to be taken against external noise. Also, in the stage of developing a new type of turbomolecular pump 100 with such a function, the communication quality can be evaluated by identifying the noise immunities in the communications between the master circuit and the slave circuits through various tests. Thus, measures to increase the noise resistance can be taken from the development stage. In the stage of mass production of turbomolecular pumps 100, variations in noise immunity due to the variations among devices can be identified in the manufacturing process and used as one of the quality evaluation items for the turbomolecular pumps 100 to be mass-produced.

The present disclosure is not limited to the examples described above. Various modifications, alternations, and combinations are possible within the scope of the disclosure described in the claims unless otherwise specified in the above description. Also, the effects of the example described above are merely examples of the effects of the present disclosure. The effects of the present disclosure are not limited to the effects described above.

For example, the slave circuits in the present example are the magnetic bearing control circuit 201 and the motor control circuit 202, but any circuit that controls the operation of a portion of the vacuum pump may serve as a slave circuit according to the present disclosure. Examples of such a slave circuit include an Ethernet circuit that can output information of the turbomolecular pump 100 to an external device and input information from the external device to the turbomolecular pump 100.

The invention claimed is:

1. A vacuum pump comprising:

a control means configured to control an operation of at least one portion included in the vacuum pump, wherein:

the control means includes one or more slave circuits connected to the at least one portion to control the operation of the at least one portion and a master circuit connected to the one or more slave circuits to control the one or more slave circuits, the master circuit is configured to perform periodical communications with the one or more slave circuits and obtain a history of communication states of the communications, and the history of communication states includes a number of communication errors of each type of communication error.

2. The vacuum pump according to claim 1, wherein the history of communication states includes at least one of request content of data, response content of data, an error type, or a time of a most recent communication error.

3. The vacuum pump according to claim 1, wherein the control means includes a memory connected to the master circuit, and the memory is configured to store the history of communication states.

4. The vacuum pump according to claim 1, wherein the control means is configured to delete the history of communication states that is previously stored in memory when recent history of the communication states is stored.

5. The vacuum pump according to claim 4, wherein the deleted history of communication states includes the number of communication errors of each type of communication error.

6. A vacuum pump comprising:

a control means configured to control an operation of at least one portion included in the vacuum pump, wherein the control means includes a slave circuit connected to each of the at least one portion to control the operation of the at least one portion and a master circuit connected to the slave circuit, the master circuit is configured to perform periodical communications with the slave circuit and obtain a history of communication states of the communications, and the control means is configured to issue an alarm to an outside based on the history of communication states.

7. The vacuum pump according to claim 6, wherein the alarm is issued based on a total number of communication errors in a predetermined period.

8. The vacuum pump according to claim 6, wherein the alarm is issued, based on an occurrence ratio of communication errors in a predetermined period.

9. The vacuum pump according to claim 6, wherein the alarm is issued in response to a plurality of communication errors occurring in succession.

10. A controller for controlling an operation of at least one portion included in a vacuum pump, the controller comprising:

one or more slave circuits connected to the at least one portion to control the operation of the at least one portion; and a master circuit connected to the one or more slave circuits to control the one or more slave circuits, wherein:

the master circuit is configured to perform periodical communications with the one or more slave circuits and obtain a history of communication states of the communications, and the history of communication states includes a number of communication errors of each type of communication error.

* * * * *